US009162782B2

(12) United States Patent
Mellin

(10) Patent No.: US 9,162,782 B2
(45) Date of Patent: Oct. 20, 2015

(54) APPARATUS FOR PACKING STACKS OF FOLDED TISSUE PRODUCTS AND THE LIKE WITH FILM

(75) Inventor: André Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 773 days.

(21) Appl. No.: 13/525,441

(22) Filed: Jun. 18, 2012

(65) Prior Publication Data

US 2013/0333338 A1 Dec. 19, 2013

(51) Int. Cl.

| | |
|---|---|
| ***B65B 25/14*** | (2006.01) |
| ***B65B 11/28*** | (2006.01) |
| ***B65B 11/30*** | (2006.01) |
| ***B65B 11/32*** | (2006.01) |
| ***B65B 11/36*** | (2006.01) |
| ***B65B 11/38*** | (2006.01) |
| ***B65B 11/40*** | (2006.01) |
| ***B65B 11/42*** | (2006.01) |
| ***B65B 11/46*** | (2006.01) |
| ***B65B 19/22*** | (2006.01) |
| ***B65B 63/02*** | (2006.01) |
| ***B65B 63/04*** | (2006.01) |

(52) U.S. Cl.

CPC ..... *B65B 11/30* (2013.01); *B65B 25/145* (2013.01); *B65B 63/02* (2013.01); *B65B 63/04* (2013.01)

(58) Field of Classification Search

CPC ..... B65B 11/28; B65B 11/30; B65B 11/32; B65B 11/36; B65B 11/38; B65B 11/40; B65B 11/42; B65B 11/46; B65B 25/14; B65B 25/145; B65B 63/02; B65B 9/00; B65B 49/00; B65H 45/16

USPC ..... 53/228–234

See application file for complete search history.

(56) References Cited

U.S. PATENT DOCUMENTS

| | | | | | |
|---|---|---|---|---|---|
| 3,885,374 | A | * | 5/1975 | Schmermund | 53/234 |
| 4,183,191 | A | * | 1/1980 | Focke | 53/225 |
| 4,208,854 | A | * | 6/1980 | Seragnoli | 53/575 |
| 4,730,442 | A | * | 3/1988 | Focke et al. | 53/579 |
| 4,845,924 | A | | 7/1989 | Focke et al. | |
| 5,457,932 | A | * | 10/1995 | Spada et al. | 53/234 |

(Continued)

FOREIGN PATENT DOCUMENTS

| | | | |
|---|---|---|---|
| DE | 3437813 | A1 | 4/1986 |
| DE | 202004016697 | U1 | 4/2005 |

(Continued)

OTHER PUBLICATIONS

PCT International Search Report, mailed Aug. 8, 2013, 101 pages.

*Primary Examiner* — Andrew M Tecco
*Assistant Examiner* — Praachi M Pathak
(74) *Attorney, Agent, or Firm* — Peter D. Meyer

(57) ABSTRACT

An apparatus for packaging stacks of folded tissue products or the like with blanks of plastic film is disclosed. The apparatus comprises at least one pocket comprising a plurality of side walls disposed within a drum having a longitudinal axis, a plurality of adjacent grooves disposed upon the side walls within the pocket, insertion means for inserting a single stack in the pocket, along an insertion direction, with the interposition and consequent folding of a corresponding blank, and control means adapted to drive the stop means along the insertion direction in a coordinated manner with respect to the operation of the insertion means.

20 Claims, 6 Drawing Sheets

(56) References Cited

U.S. PATENT DOCUMENTS

| | | | | | |
|---|---|---|---|---|---|
| 5,459,979 | A | | 10/1995 | Tommasi | |
| 5,480,372 | A | * | 1/1996 | Gwiazdon et al. | 493/437 |
| 5,533,323 | A | * | 7/1996 | Osti et al. | 53/466 |
| 5,600,935 | A | * | 2/1997 | Isani et al. | 53/234 |
| 5,657,609 | A | * | 8/1997 | Spada et al. | 53/135.1 |
| 5,946,884 | A | * | 9/1999 | Nordstrom et al. | 53/225 |
| 6,023,909 | A | * | 2/2000 | Boldrini | 53/234 |
| 6,105,948 | A | | 8/2000 | Young | |
| 7,454,879 | B2 | * | 11/2008 | Boldrini et al. | 53/378.3 |
| 8,337,374 | B2 | * | 12/2012 | Garthaffner et al. | 493/39 |
| 2001/0052217 | A1 | * | 12/2001 | Spatafora | 53/234 |
| 2009/0145088 | A1 | * | 6/2009 | Bretthauer | 53/442 |
| 2013/0333338 | A1 | * | 12/2013 | Mellin | 53/545 |

FOREIGN PATENT DOCUMENTS

| | | | |
|---|---|---|---|
| FR | 1250384 | A | 1/1961 |
| GB | 14107082 | A | 10/1975 |
| JP | H10273105 | A | 10/1998 |
| WO | WO 2011/151774 | | 12/2011 |

* cited by examiner

APPARATUS FOR PACKING STACKS OF FOLDED TISSUE PRODUCTS AND THE LIKE WITH FILM

FIELD OF THE INVENTION

The present disclosure is related to packaging folded products within film. More particularly, the present disclosure relates to packaging folded tissue products within a film overwrap. Even more particularly, the present disclosure relates to an improved apparatus for the packaging of compressible articles, especially stacks of facial tissues and paper handkerchiefs into a blank formed from a plastic film or the like.

BACKGROUND OF THE INVENTION

In the packaging of pulp products, especially stacks of facial tissues and paper handkerchiefs, a considerable problem arises because the articles to be packaged are compressed to a considerable extent. It is therefore difficult to produce an exact cuboid pack.

To this end the drum machines for wrapping packs of facial tissues and paper napkins generally use an apparatus called a "revolver." The revolver is essentially a drum that rotates about a horizontal axis. The revolver is typically provided with a plurality of radially disposed chambers, often called "revolver pockets." These revolver pockets generally provide the forming geometry for the articles to be packaged. Within the revolver pockets, the packs of facial tissues and paper handkerchiefs to be wrapped are individually inserted in rapid succession. Each pack to be wrapped is fed by a driving chain and compressed prior to the introduction into a corresponding revolver pocket.

The insertion takes place with the simultaneous interposition of a film of suitable plastic material provided for wrapping the facial tissues and/or paper handkerchiefs (i.e., to make up the envelope) after having been properly folded around the sides of the pack and closed by welding and/or gluing. Owing to the high rotary speed of the revolver, it is usually necessary to feed and compress the facial tissues and/or paper handkerchiefs at a rate sufficiently high to allow for successively engaging all the revolver pockets to ensure a convenient productive capacity of the plant. This implies a synchronization with minimum tolerance margins of the steps for feeding, squeezing and, then, inserting the facial tissues and/or paper handkerchiefs into the revolver pockets, mainly as a function of the revolver peripheral speed and of the variation of the momentum to be imparted to each pack prior to the insertion thereof into the revolver pockets.

Thus, the adoption of suitable criteria in the management of the plant, in relation to both the choice of the most suitable operating speeds and the maintenance and adjustment of the individual devices, is required to allow provide complete operative integration and maximum reliability. It is well known, the level and rate of activities for the maintenance and adjustment of the components weigh heavily on the economic efficiency of the plant and, accordingly, on the cost of fabrication of the finished packaged product. Thus, there is a strong demand to use simpler and more robust equipment and processes to improve the reliability of the production systems and reduce the relevant costs related to the manufacture of the packaged product.

Some prior art equipment requires a stoppage for each group of napkins before operating the squeezing and the subsequent insertion thereof into the revolver pockets, and for bringing the compressive means back to the respective initial operating condition before starting the wrapping of a new group of napkins. That is, bringing the compressive means back behind the next group of napkins to be wrapped, so that the feeding thereof to the revolver results discontinuous. Moreover, the functional construction of known apparatus does not allow an increase in the output of the plant, that is, in the napkins-feeding rate, beyond a given value corresponding to the operating speed of the compressive means. In addition to this, there is the fact that the constructional complexity of this known apparatus brings about an intense servicing activity which weighs on the production cost of the packaged product. Such equipment is described in U.S. Pat. No. 4,845,924.

Another packaging machine can utilize a pair of belt conveyers converging towards an articles-compressing device which is made up of a pair of parallel horizontal superimposed belts for moving the napkins delivered from the feeding belts, and also made of a vertical operating cylinder, in a fixed position, provided with a flat head and a corresponding stationary abutment surface, to compress the thus fed napkins. However, this known apparatus also provides for a discontinuous feeding of napkins, owing to the stoppage of the belts of the compressive device, which is necessary to allow for the intervention of the compressive cylinder. Accordingly, the output capacity of the plant cannot be raised beyond a value corresponding to the operating speed of the cylinder. Such equipment is described in German Patent DE 2322878.

Other machines or processes related to high speed packaging can use a drum provided with radial pockets with dimensions that are suitable for the product to be packaged, inside which the stacks of product to be packaged are inserted in rapid succession, with the simultaneous interposition of one blank plastic film, so as to obtain the complete wrapping of each stack, completed by welding applied on the film to obtain a closed packaging. This arrangement of equipment of this type is described in U.S. Pat. Nos. 4,845,924 and 5,459,979.

In machines of this kind, due to the high operation speed that is required to ensure suitable productivity, it is very complex to compress the stack, keep its correct geometry and carry out the insertion inside the pockets of the drum without causing deformations or faults in the wrapping by the film. In particular, but not exclusively, it is difficult, if not impossible, to keep control of the position of the film and of the compression in the radial direction of insertion during the wrapping step when the speed increases beyond a certain limit, causing defects in the package which, in any case, can occur also when the speed is kept below said limit. Thus, it would be beneficial to provide an apparatus for packaging stacks of facial tissues and/or paper handkerchiefs that provides better throughput, increased reliability, and a packaged product with a better finished appearance to increase consumer appeal.

SUMMARY OF THE INVENTION

The present disclosure provides for an apparatus for packaging stacks of folded tissue products or the like with blanks of plastic film. The apparatus comprises at least one pocket comprising a plurality of side walls disposed within a drum having a longitudinal axis, a plurality of adjacent grooves disposed upon the side walls within the pocket, insertion means for inserting a single stack in the pocket, along an insertion direction, with the interposition and consequent folding of a corresponding blank, and control means adapted to drive the stop means along the insertion direction in a coordinated manner with respect to the operation of the insertion means. The pocket has a leading edge coexistant with the surface of the drum. Each of the grooves has a longitudinal axis generally parallel to the longitudinal axis of the drum. The plurality of grooves extends from the leading edge to a position internal to the pocket. The pocket is operatively associated with stop means of the stack completely inserted within the pocket. The stop means comprise suction means adapted to keep hold of the film, and to hold off the same film at least in an extraction step wherein the stack is extracted from the pocket.

The present disclosure also provides a pocket for a drum suitable for use in packaging stacks of folded tissue products or the like with blanks of plastic film. The pocket comprises a plurality of side walls disposable within the drum having and a plurality of adjacent grooves disposed upon the side walls within the pocket. The pocket has a leading edge coexistant with the surface of the drum. Each of the grooves has a longitudinal axis generally parallel to a longitudinal axis of the drum. The plurality of grooves extends from the leading edge to a position internal to the pocket.

The present disclosure also provides a leading edge for a pocket for a drum suitable for use in packaging stacks of folded tissue products or the like with blanks of plastic film. The leading edge comprises a plurality of adjacent grooves disposed upon the side walls within the pocket. Each of the grooves has a longitudinal axis generally parallel to a longitudinal axis of the drum. The plurality of grooves extends from the leading edge to a position internal to the pocket.

DESCRIPTION OF PREFERRED EMBODIMENTS

Figure 1:
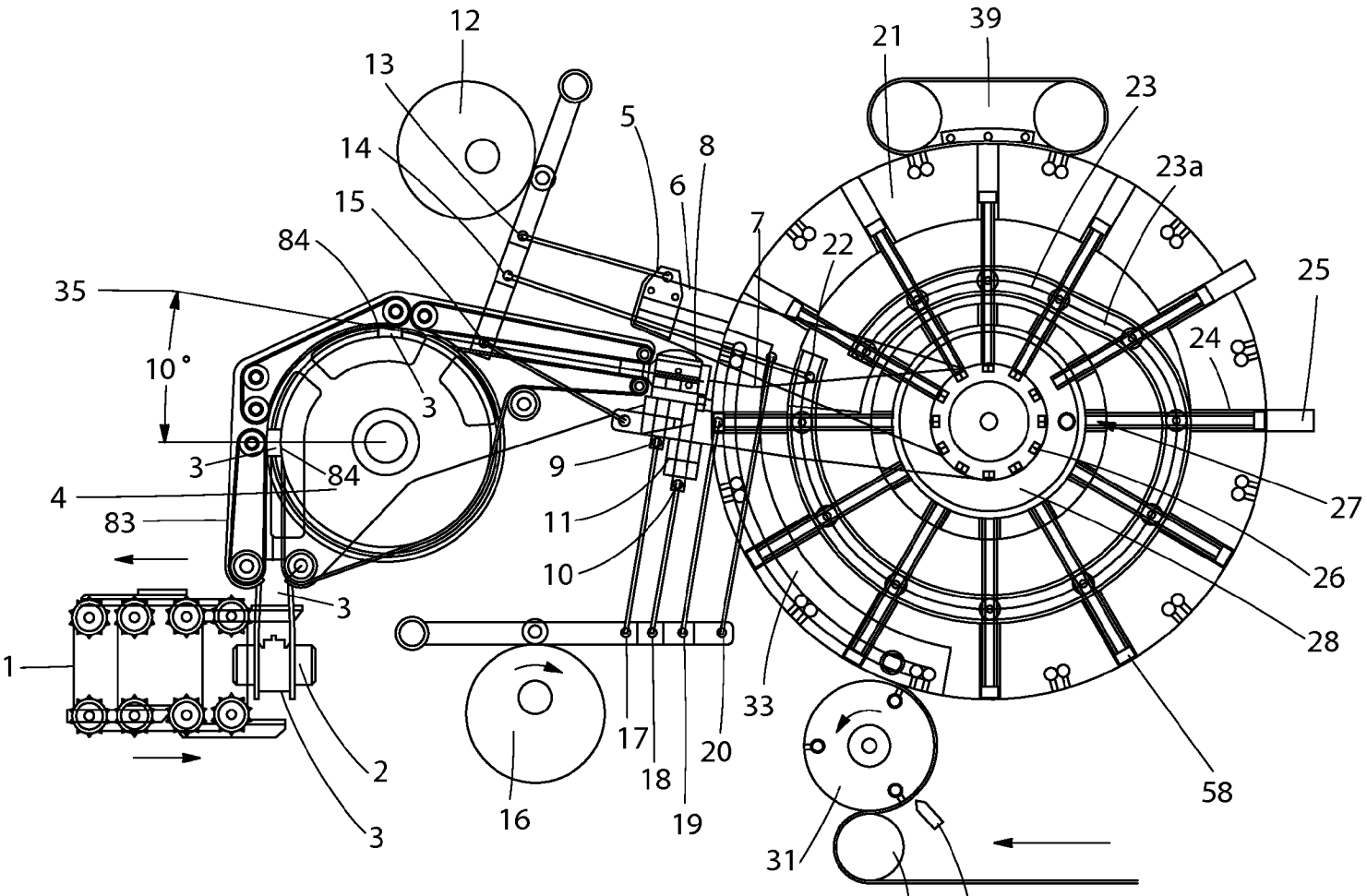
FIG. 1 is a cross-sectional view of an exemplary packaging machine according to the present disclosure.
Figure 2:
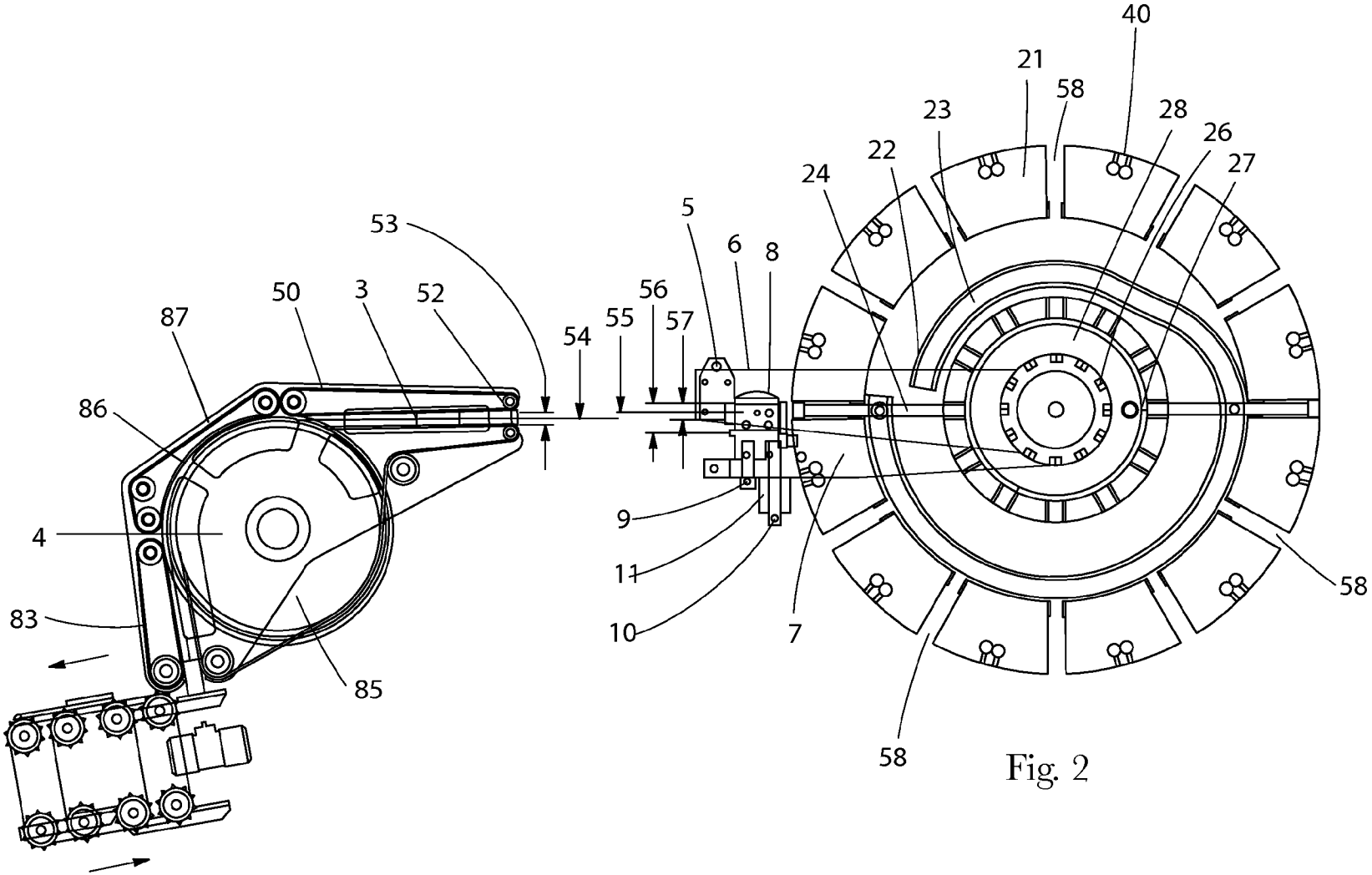
FIG. 2 is a cross-sectional view of the in-feed, compression, inserting devices, and packaging drum of the exemplary packaging machine of FIG. 1.

FIGS. 1 and 2 provide cross-sectional views of an exemplary apparatus for packaging stacks of folded tissue products. Generally a packaging machine or apparatus will provide a device 1 for inserting the product (e.g., stacks 3 of folded products to be packaged) into a feed system. A plurality of belts 2 directed from an upstream folding machine control the feed of the folded product into the device 1.

A device 4 feeds the stacks 3 into a compression device or system 8. This typically occurs along a plane 35 that is generally inclined with respect to the horizon by about 10°. As shown with particularity in FIG. 2, belts 50 provide pre-compression and feed the stacks 3 into the device 4. A pair of deviation rollers 52 disposed distal from the in-feed of the stacks 3 and in contacting engagement with the belts 50 can be adjusted relative to each other (i.e., displaced) as a function of the product to be packaged. A stack 3 of products that have been pre-compressed can then be inserted into a compression device 8 arranged downstream. The apparatus also provides a device 5 for the radial insertion of the stacks 3 into a packaging drum 21. The packaging drum 21 is provided with pockets 58 disposed radially about the packaging drum 21. The pockets have an adjustable width in order to accommodate the product to be packaged. An upper oscillating arm 6 is provided to insert the stacks into the drum 21. A lower oscillating arm 7 slidably supports, along its axis, the aforementioned device 8 for compressing the stacks 3. The lower oscillating arm 7 has a lower compression plate 9 that has a reciprocating motion in a direction orthogonal relative to the axis of the arm 7. A front plate 10 for stopping the stacks 3 reciprocates in a direction orthogonal to that of the lower arm 7.

A multiple cam upper actuation device 12 drives a first crank and rod upper device 13 for controlling the insertion device 5 of the stacks 3. In other words the device 12 displaces the device 5 along the arm 6. The upper actuation device 12 also has a second crank and rod upper device 14 for radially controlling a mobile cam portion 22 for inserting the plastic packaging film. The actuation device 12 also provides for a third crank and rod upper device 15 for controlling the radial displacement of the device 8 for compressing the stacks 3.

A multiple cam lower actuation device 16 drives a first crank and rod lower device 17 for controlling the lower compression plate 9 of the stacks 3. The lower actuation device 16 also provides a second crank and rod lower device 18 for controlling the front stop plate 10 of the stacks 3. The lower actuation device 16 also has a third crank and rod lower device 19 for controlling the rotation of the lower oscillating arm 7. Further the lower actuation device 16 provides a fourth crank and rod lower device 20 for controlling the rotation of the upper oscillating arm 6.

Both cam actuation devices provide a mechanism that provides an eccentrically rotating disc that peripherally defines a cam surface with where a crank comes into tangential contact. The crank is hinged at one end and contacts the cam surface at a crank intermediate point so that the same crank is driven in oscillation around a hinge point in response to the rotation of the disc. The rods linking the cranks to the various controlled devices are in turn pivotably connected to the same devices and to the cranks in predetermined points between the crank intermediate point of contact with the disc and a free end of the crank. The geometric characteristics are suitably set as a function of the mutually coordinated displacements.

Cam portion 22 drives extractors 24 that are preferably designed to assist in the insertion of the packaging film with in the individual pockets 58. Cam portion 22 provides a radially displaceable end portion (as seen driven by the second upper device 14) of a fixed cam 23 that revolves according to a curl around the axis of the drum on a side thereof. In practice, the fixed cam 23 does not traverse about a closed ring, but rather an open loop. The opening of the loop is defined by a circumferential and radial discontinuity (e.g., "step-like" discontinuity) in the film insertion area. Cam portion 22 is preferably provided in cooperative engagement with the discontinuity and is displaceable radially between a radially external position (i.e., the guide cam larger diameter) and a radially internal position (i.e., guide cam smaller diameter). The displacement accordingly drives the movement of the extractors.

In an area 23*a* opposite the discontinuity of the fixed cam 23, the fixed cam 23 then moves in a continuous manner from the smaller to the larger diameter to drive the extractors 24 between a rearward displaced position and a radially extracted position for pushing the packaged stacks 3 out of the pockets 58. The outlet of the packages from the drum 21 is shown as reference numeral 25 in FIG. 1.

A band of film 29 fed by a cylinder 30 in a continuous manner for packaging the product is cut in pre-defined length blanks 38 by a cutting cylinder 31 having a blade 32. A transverse welding system 39 the welds the film once it has been wrapped around the stacks 3.

As shown in FIG. 2, a series of passages (40) formed in the drum 21 provide for the application of positive and/or negative pressure upon the periphery of the drum 21. The passages 40 communicate with a fixed manifold 33 that run along a defined, circumferential arc. Bearings 41 provide a mechanical drive link with the extractors 24. A transmission shaft 42 connected to the drum 21 is actuated by a motor 43 which also drives a shaft 44 for controlling the film feeding and cutting system. The arms 6 and 7 are coupled with the shaft 42 and are disposed adjacent one another on one side of the drum 21. Motor 43 transmits motion to shaft 45 for controlling the upper actuation device 12, shaft 46 for controlling the lower actuation device 16, shaft 47 for controlling the stack feeding device 4, and shaft 48 for controlling the stack inserting device 1.

Returning to FIG. 2, reference numerals 53 through 57 inclusive denote various geometric reference elements for the operation of the machine. Plane 54 defines the middle of the height 53 of the stacks fed by the device 4. The plane 54 is preferably equidistant from the rollers 52 and the middle of the height or opening 56 of the compression device 8 during the insertion of the product at the bottom dead centre of the lower arm 7. Plane 55 also corresponds to the middle of the height of compression at maximum compression and coincides with a diametral plane of drum 21. One of skill in the art will recognize that the compression height 57 can be adjusted as a function of the product to be packaged.

As shown in FIGS. 1 and 2, a sequential valve 27 is provided within drum 21. Sequential valve 27 is preferably fixably linked fixed cam 23 for controlling the depression on the side of insertion of the film within a pocket disposed within drum 21. In practice, in the point where the film is fed on the drum 21 by means of the cylinder 31, the sequential valve 27 activates the suction exerted by the extractors 24, turning the suction off when product has been inserted completely, or at about /3;4 of the complete insertion run.

A second sequential valve 26 (crown valve) is fixably connected to shaft 42 integral to drum 21 and is activated at about /2;3 of the insertion step, as a result of the movement of the extractors 24. When the tail end of the extractors 24 abuts the bottom of grooves defined by the crown valve 26, the suction exerted by the extractors themselves is turned off. Before the insertion is complete, the film is disposed outwardly effectively providing adhesion of the film to the stack 3 due to the suction applied to the end flaps of the blank of film 38 by the passages 40 disposed on the surface of the drum 21.

A valve 26 disposed proximate to the bottom of the relative grooves can be provided with different diameters to control the insertion depth where one desires to turn off the applied suction. A depression chamber 28 transmits the suction to the extractors 24 and can be fed by a vacuum source with values. This was found to provide a safe positioning of the film during the insertion step.

The machine described can be arranged for vertical or horizontal feeding. It is believed that to provide best operation, the insertion plane 35 (described supra) have a certain inclination relative to the horizontal, preferably descending towards the drum 21 and preferably equal to about 10°. In such a way the stacks 3, as shall be comprised more clearly hereafter, adhere to the front stop plate in perfectly perpendicular arrangement with respect to the plane defined by the lower compression plate 9.

Figure 3:
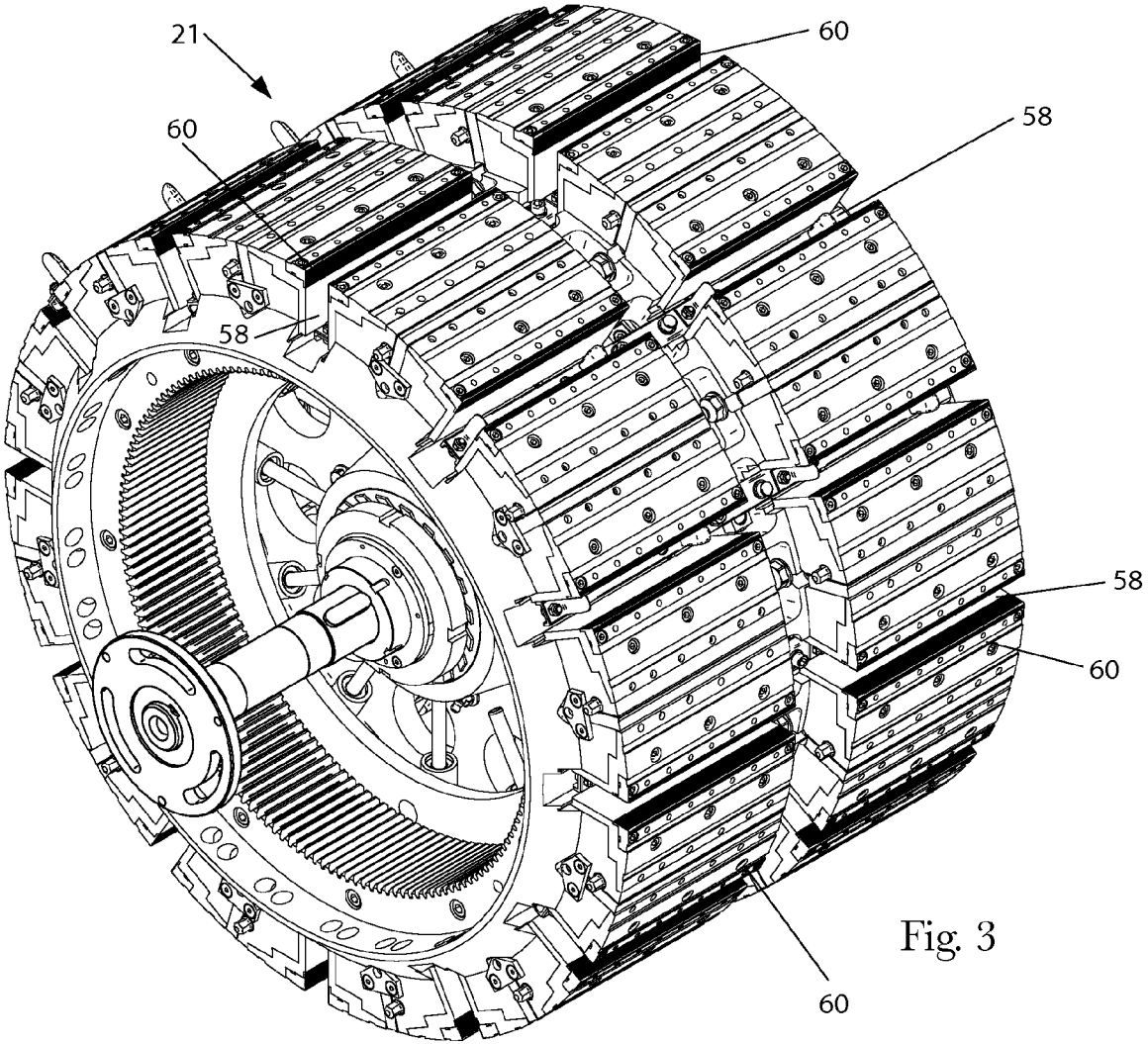
FIG. 3 is a perspective view of an exemplary but non-limiting packaging drum.

Referring to FIGS. 1-3, the machine according to the present disclosure operates as described infra. Product stacks 3 are fed by the belts 2 into the product guides 82 in adherence with the stop plate 81. The stacks 3 are inserted with a continuous vertical and horizontal movement with constant speed equal to that of the belts 83 and 86 driven by the cylinder 85 of the feeding device 4. The belts 83, 86 receiving each stack by engaging with it at opposite ends, and providing a slight compressive force. The stacks 3 are then forwardly displaced into the cavities 84 formed in the cylinder 85. After the stacks 3 are detached from the belts 83 they are kept compressed in a direction oriented radially inward towards the cylinder 85 with outer belts 87. Outer belts 87 are driven by the cylinder 85 through friction with its surface. In such a way the correct peripheral speed is maintained without causing the stacks 3 themselves to become deformed.

When the stacks 3 are removed from the cylinder 85, the belts 50 and internal belts 86 transport the stacks to their insertion point within the compression device 8. The outlet rollers 52 of the belts 50, 86 are preferably adjusted to provide an equidistant position with respect to the middle plane 54 as a function of the height of the product to be packaged. The speed of the belts 50, 86 can vary according to the diameter of the cylinder 85 and to the number of cavities 84 present within the cylinder 85. The compressed height of the stacks 3 upon exiting the belts 50, 86 is about the same as that of the finally packaged product. The stacks 3 are then inserted into the compression device 8 in its condition of maximum opening 56 at the bottom dead centre of the arm 7. Preferably, the height 56 is normally 50% greater with respect to the height of the stacks 3 dispensed from the outlet of the belts 50, 86. When the stack 3 is inserted into the compression device the stack 3 expands and becomes adherent with the stop plate 10 which exerts a suction assisting with alignment with the stop plate 10.

It should be noted that the control of the stacks 3 within drum 21, with the film wound in the pockets, is also provided by the extractors 24 which, due to the movement of the cam portion 22 in the area of insertion of the stack 3 into the pocket, moves rearwards providing an inner side abutment accompanying the same stacks 3 in their insertion displacement.

Further, the suction exerted by the extractors 24 contributes to keep the stack and the wrapping film in an orderly fashion. When the packet passes in correspondence with the welding system, it is welded and then expelled thanks to the ejection of its extractor driven by the evolution 23*a* of the cam 23 in the area diametrically opposed to that of insertion. The control of the suction/depression exerted by the extractors 24 is synchronized along the appropriate rotation angle of the drum, by means of the valves 26 and 27.

The stack stop plate 10, fixedly connected to the basement, with its depression system, for providing alignment of the stack 3, is in turn capable of ensuring a significant improvement of the insertion operations, for speed, precision and constructive optimization. The extractor 24 accompanies the insertion of the stack 3 into the pocket 58 with precise control of the position of the film through fluid connection to the vacuum source.

Figure 4:
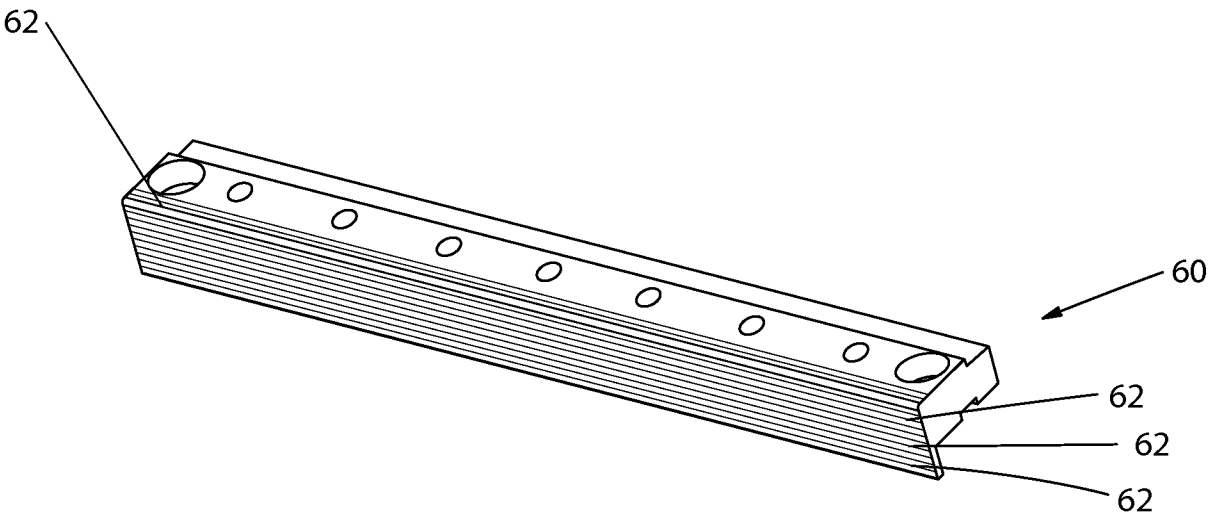
FIG. 4 is a perspective view of an exemplary leading edge for a packaging drum.
Figure 5:
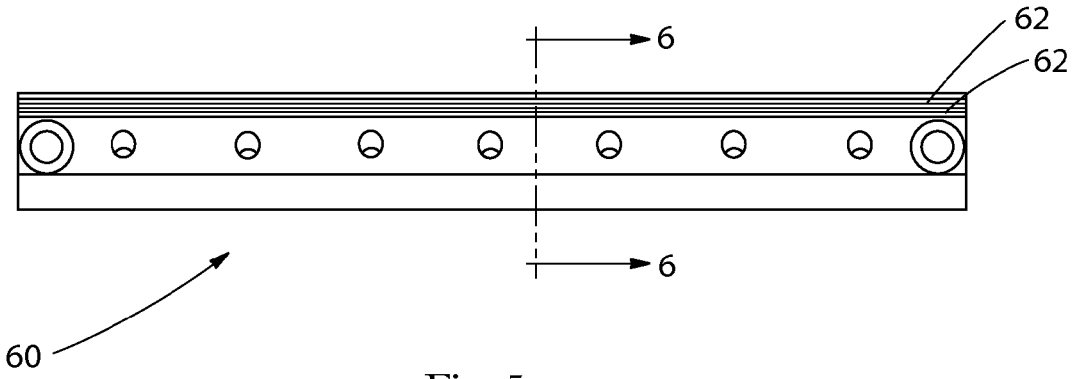
FIG. 5 is a plan view of the exemplary leading edge of FIG. 4 viewed from above.
Figure 6:
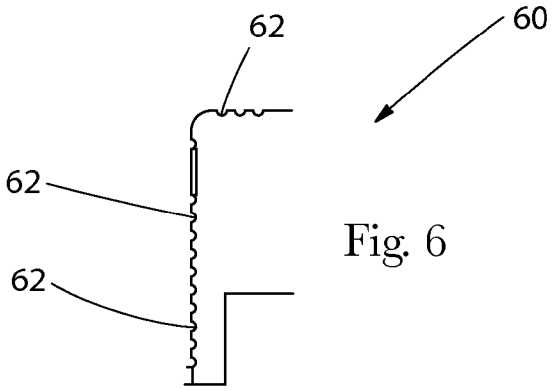
FIG. 6 is a sectional view of the exemplary leading edge for a packaging drum of FIG. 5 taken along line 6-6; and, FIG. 7 is an exploded view of the exemplary leading edge for a packaging drum of FIG. 4 in relation to an exemplary packaging drum.
Figure 7:
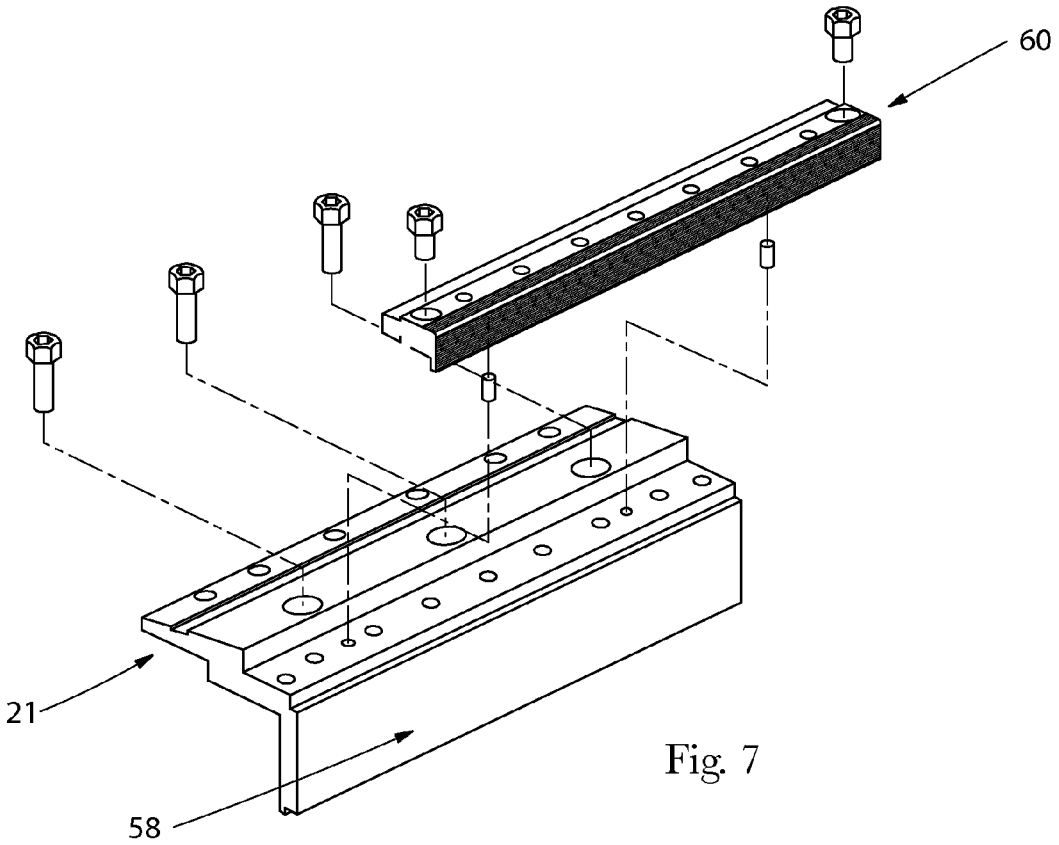

The pocket 58 is preferably provided with leading edges 60 that provide a grooved geometry to the entry point of the pocket 58. An exemplary leading edge 60 is provided in FIGS. 4-6. In a preferred embodiment, the grooves 62 of leading edge 60 are generally orthogonal to the insertion direction of the film and accompanying stacks 3 inserted into pocket 58 and collinear with the axis of rotation of drum 21. In other words, the grooves 62 of leading edge 60 are provided at least substantially in the cross-machine direction of travel of the product through the apparatus. In a preferred embodiment, the individual grooves 62 are provided substantially parallel to the longitudinal axis of drum 21. However, one of skill in the art will also appreciate other geometries are possible. This includes the provision of grooves 62 with an angle relative to the longitudinal axis of drum 21 to provide the groves with a 'slanted' configuration. Providing a plurality of grooves 62 with an angle relative to the longitudinal axis of drum 21 in a collectively elongate manner could result in grooves 62 having a resulting "V" geometry or an inverted "V" configuration. Additionally, grooved 62 can be provided as a plurality of sinusoidal continuous curves.

Independent of the geometry of the grooves 62, it is believed that the grooves 62 should be provided in order to increase the surface area of the leading edge 60. Without desiring to be bound by theory, it is believed that by increasing the surface area of leading edge 60, the corresponding frictional forces exerted upon the film being inserted (or pulled) into pocket 58 (along with the stack 3) results in a more even insertion of the film into pocket 58. A more even insertion of film into pocket 58 can result in a more repeatable and equitable distribution of film about stack 3. Clearly, one of skill in the art will recognize the clear benefit of a more robust packaging having significantly better consumer appeal.

Grooves 62 are preferably provided upon the portion of leading edge 60 that extends within the pocket 58. Additionally, grooves 62 can be provided upon the portion of leading edge 60 that is disposed upon the surface of drum 21 disposed proximate to pocket 58.

In most current commercial embodiments, drum 21 is typically provided with a 12-pole design for the production of packages of stacks of folded tissue products. Such a 12-pole design has 12 pockets symmetrically and evenly spaced about the circumference of drum 21. A typical drum 21 diameter is 600 mm to allow the film cut-off length arranged on the surface of drum 21. Independent from the diameter of drum 21 (which could be vary as a function of cut-off length and pack size) for a specific execution of a 12-pole drum 21 having a diameter of 600 mm to produce packages of stacks of folded tissue products having dimensions of about 52 mm×23 mm×110 mm it was found that grooves 62 covered about 25% of the surface of both side walls of pocket 58. It is preferred that grooves 62 starting at the leading edge 60. Preferably, grooves 62 are provided with an overall depth of about 0.2 mm. The corresponding pitch between adjacent groves spaced radially from the longitudinal axis of drum 21 is preferably about 0.6 mm. Further, it is preferred that the top width of groove 62 be about 0.4 mm and have a groove distance at root of 0.2 mm. Additionally, it is preferred that grooves 62 be provided within pocket 58 to provide a total coverage area of from about 15% to about 30%.

It is believed that such a leading edge 60 can provide symmetrical film in-feed into the pocket 58 while under pressure (e.g., vacuum feed) and provide better registration of the stack 3 to the film to provide the finally formed product. Without desiring to be bound by theory, it is believed that providing cross-machine direction grooves 62 at the leading edge of the pocket 58 provides a source of equal friction on both sides of the pocket 58 during in-feed of the stack 3 into the pocket 58.

After arms 6 and 7 have reached a mutual alignment position that is suitable for allowing the insertion of the stack in a pocket 58 of the drum 21, the insertion device 5, moves radially toward the drum 21 until it abuts against the stack 3 of compressed product. Once a position in which the distance from the periphery of the drum 21 corresponds to the width of the stack 3 has been reached, the mobile cam portion 22 moves radially rearward with the stack 3 of product to provide secure placement within pocket 58 of drum 21 for complete insertion.

Stack 3 and arms 6 and 7 rotate in phase with one another and with one of the pockets 58 of the drum 21. The device 5 proceeds forwards until the stack 3 is completely inserted within pocket 58. Vacuum provided by the extractor is applied to the film that has been disposed upon the surface of drum 21. The film is disposed to be positioned upon the surface of drum 21 so that equal portions of film are disposed on either machine direction side of pocket 58. Passages 40 connected to a source of negative pressure (e.g., vacuum) is applied to a blank of film that has been previously interposed for the wrapping operation. Positioning of the film can be provided upon the surface of drum with any means known to those of skill in the art.

After insertion of a stack 3, lower arm 7 and the compression plate 9 return to the starting position to receive a new stack 3 of products. The upper arm 6 arrives at the top dead centre and inverts its movement, whereas the insertion device begins its radial movement along the arm 6 so as to return to the starting position, without interfering, as already mentioned, with the upper compression plate 64 which, being part of the device 8, is already in position to receive a new stack 3. The drum 21 continues its rotation with constant speed and a new packaging pocket 58 proceeds to the point in phase with the arms 6, 7. The system is ready for a new cycle.

Returning to follow the path of the stacks inside the drum 21, it should be noted that the control of the stacks, with the film wound in the pockets, is also taken up by the extractors 24 which, due to the movement of the cam portion 22 in the area of insertion, move rearwards thus providing an inner side abutment accompanying the same stacks in their insertion displacement The suction exerted by the extractors 24 contributes to keep the stack 3 and the wrapping film in an orderly fashion. When the packet passes in correspondence with the welding system, it is welded and then expelled thanks to the ejection of its extractor driven by the evolution 23*a* of the cam 23 in the area diametrically opposed to that of insertion. The control of the suction/depression exerted by the extractors 24 is synchronized along the appropriate rotation angle of the drum, by means of the valves 26 and 27.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. An apparatus for packaging stacks of folded tissue products with blanks of plastic film, the apparatus comprising:

at least one pocket comprising a plurality of side walls disposed within a drum having a longitudinal axis, said pocket having a leading edge coexistant with an outer surface of said drum;

a plurality of adjacent grooves disposed upon said side walls within said pocket, each of said grooves having a longitudinal axis substantially parallel to said longitudinal axis of said drum, said plurality of grooves extending from said leading edge to a position internal to said pocket;

insertion means for inserting a single stack in said pocket, along an insertion direction, with the interposition and consequent folding of a corresponding blank, said pocket being operatively associated with stop means of the stack completely inserted within said pocket;

control means adapted to drive said stop means along said insertion direction in a coordinated manner with respect to the operation of said insertion means, said stop means comprising suction means adapted to keep hold of said film, and to hold off the same film at least in an extraction step wherein the stack is extracted from the pocket.

2. The apparatus of claim 1 wherein a pitch between adjacent grooves disposed within said pocket is about 0.6 mm.

3. The apparatus of claim 1 wherein said sidewalls further comprise a surface area, said plurality of adjacent grooves being disposed over at least about 15% to at least about 30% of said surface area.

4. The apparatus of claim 3 wherein said plurality of adjacent grooves are disposed over at least about 25% of a surface area of said side walls of said pocket.

5. The apparatus according to claim 1, wherein said control means are adapted to drive said stop means in a simultaneous manner with respect to said insertion means, in order to provide an abutment to said stack during the whole insertion step in the pocket.

6. The apparatus according to claim 5, wherein said stop means are reciprocatingly movable, moving in said insertion step between a forward displaced position, wherein a stop end is in correspondence to an inlet of said pocket, and a rearward displaced position, wherein said stop end provides an abutment to said stack completely inserted in said pocket.

7. The apparatus according to claim 5, wherein said stop means are associated with valve means adapted to obstruct said suction means for removing the film holding effect when said stop means approach said rearward displacement position, at about ⅔ of the rearward displacement run.

8. The apparatus according to claim 1 further comprising a plurality of adjacent grooves disposed upon a surface of said drum adjacent said leading edge.

9. A pocket for a drum suitable for use in packaging stacks of folded tissue products with blanks of plastic film, the pocket comprising:

a plurality of side walls disposable within said drum having, said pocket having a leading edge coexistant with said surface of said drum;

a plurality of adjacent grooves disposed upon said side walls within said pocket, each of said grooves having a longitudinal axis generally parallel to a longitudinal axis of said drum, said plurality of grooves extending from said leading edge to a position internal to said pocket.

10. The apparatus of claim 9 wherein a pitch between adjacent grooves disposed within said pocket is about 0.6 mm.

11. The apparatus of claim 9 wherein said sidewalls further comprise a surface area, said plurality of adjacent grooves being disposed over at least about 15% to at least about 30% of said surface area.

12. The apparatus of claim 11 wherein said plurality of adjacent grooves are disposed over at least about 25% of a surface area of said side walls of said pocket.

13. A leading edge for a pocket for a drum having a surface and being suitable for use in packaging stacks of folded tissue products or the like with blanks of plastic film, the leading edge comprising:

a plurality of adjacent grooves disposed upon said side walls within said pocket, each of said grooves having a longitudinal axis generally parallel to a longitudinal axis of said drum, said plurality of grooves extending from said leading edge to a position internal to said pocket.

14. The apparatus of claim 13 wherein a pitch between adjacent grooves disposed upon said leading edge is about 0.6 mm.

15. The apparatus of claim 13 wherein said leading edge is disposable upon a leading edge of an apparatus for packaging stacks of folded tissue products with blanks of plastic film.

16. The apparatus according to claim 15 further comprising a second plurality of adjacent grooves disposed upon said leading edge, said second plurality of grooves being disposed proximate to said leading edge and upon said surface of said drum.

17. The apparatus of claim 15 wherein said apparatus comprises at least one pocket comprising a plurality of side walls disposed within a drum having a longitudinal axis, said leading edge of said pocket being coexistant with said surface of said drum.

18. The apparatus of claim 17 wherein said grooves have a longitudinal axis generally parallel to said longitudinal axis of said drum.

19. The apparatus of claim 18 wherein said grooves have a longitudinal axis parallel to said longitudinal axis of said drum.

20. The apparatus of claim 17 wherein said grooves are disposed over at least about 15% to at least about 30% of a surface area of said sidewalls.

* * * * *

UNITED STATES PATENT AND TRADEMARK OFFICE

CERTIFICATE OF CORRECTION

PATENT NO. : 9,162,782 B2
APPLICATION NO. : 13/525441
DATED : October 20, 2015
INVENTOR(S) : Mellin It is certified that error appears in the above-identified patent and that said Letters Patent is hereby corrected as shown below:

In the claims

Column 10, Line 24, Claim 13

Delete "or the like".

Signed and Sealed this
Sixteenth Day of August, 2016

Michelle K. Lee

Michelle K. Lee
*Director of the United States Patent and Trademark Office*